US005370556A

United States Patent [19]

Olsson

[11] Patent Number: 5,370,556

[45] Date of Patent: Dec. 6, 1994

[54] KEYING SYSTEM FOR ELECTRICAL CONNECTORS

[75] Inventor: Billy E. Olsson, New Cumberland, Pa.

[73] Assignee: The Whitaker Corporation, Wilmington, Del.

[21] Appl. No.: 124,421

[22] Filed: Sep. 20, 1993

[51] Int. Cl.[5] ..... H01R 13/64

[52] U.S. Cl. ..... 439/681; 439/680; 439/677

[58] Field of Search ..... 439/677, 678, 679, 680, 439/681, 79

[56] References Cited

U.S. PATENT DOCUMENTS

| | | | |
|---|---|---|---|
| 2,902,665 | 9/1959 | D'Amico | 339/184 |
| 3,112,974 | 12/1963 | Curtis et al. | 439/680 |
| 3,177,461 | 4/1965 | Hagen et al. | 339/184 |
| 3,555,491 | 1/1971 | Moss | 339/92 |
| 4,109,987 | 8/1978 | Bourdon | 339/75 M |
| 4,376,565 | 3/1983 | Bird et al. | 339/186 M |
| 4,519,667 | 5/1985 | Canning et al. | 339/186 M |
| 4,568,134 | 2/1986 | DiMondi | 339/17 LC |
| 4,580,868 | 4/1986 | Verstijnen | 339/186 M |
| 4,726,791 | 2/1988 | Rudy, Jr. et al. | 439/677 |
| 4,764,129 | 8/1988 | Jones et al. | 439/677 |
| 4,778,411 | 10/1988 | Rudy, Jr. et al. | 439/681 |
| 4,781,626 | 11/1988 | Lazarchik | 439/680 |
| 4,832,625 | 5/1989 | Puerner | 439/681 |
| 4,895,535 | 1/1990 | Emadi et al. | 439/681 |
| 4,913,665 | 4/1990 | Sacksen | 439/677 |
| 4,925,400 | 5/1990 | Blair et al. | 439/374 |
| 4,929,184 | 5/1990 | Emadi et al. | 439/681 |
| 4,934,950 | 6/1990 | Green et al. | 439/681 |
| 4,952,175 | 8/1990 | Waters et al. | 439/681 |
| 4,986,769 | 1/1991 | Adams, III et al. | 439/681 |
| 4,990,099 | 2/1991 | Marin et al. | 439/284 |
| 5,044,994 | 9/1991 | Van Woensel | 439/681 |
| 5,147,225 | 9/1992 | Kile et al. | 439/680 |
| 5,199,885 | 4/1993 | Korsunsky et al. | 439/79 |
| 5,219,301 | 6/1993 | Frantz | 439/362 |

*Primary Examiner*—Daniel W. Howell
*Assistant Examiner*—Hien D. Vu
*Attorney, Agent, or Firm*—Anton P. Ness

[57] ABSTRACT

A keying arrangement for electrical connectors is disclosed for preventing the inadvertent mating of a plug to the wrong receptacle. The opposing walls (28,30;18,20) of the mating plug (14) and receptacle (12) have openings (52,53;36,37) formed therein that contain opposing keys (40,51;54,56,58). One key has a projection (44) and the other key (54,56,58) has a groove (62,70). The groove is in alignment with the projection where the plug and receptacle are designated to mate. The keys are used in pairs, one key at each end of the connector to prevent partial mating and the resulting potential damage. The keys are in diagonally opposite positions to prevent inadvertent partial mating along an edge of the connector. The keys are removable and replaceable so that keying configurations can be changed in the field.

12 Claims, 6 Drawing Sheets

KEYING SYSTEM FOR ELECTRICAL CONNECTORS

FIELD OF THE INVENTION

The present invention is related to a keying system for very high density electrical connectors that prevents inadvertent mating or partial mating of connector halves that are not intended to be mated.

BACKGROUND OF THE INVENTION

In electrical equipment having multiple modules or units that are interconnected, it is desirable to provide a keying system that uniquely defines plug and receptacle pairs that are to be mated. There are many such systems in use in the industry. Such systems, however, are typically molded into the walls of the mating connector halves by adding to the wall thickness or by simply adding the key structure to the surface of an existing wall. An example of the first approach is illustrated in U.S. Pat. No. 4,764,129 which discloses mating electrical connector housings having plug keys that vary in width and corresponding receptacle openings that also vary in width. An example of the second approach is illustrated in U.S. Pat. No. 4,376,565 which discloses mating electrical plug and receptacle housings having keying structures added to the outside of the plug wall and a corresponding projection on the receptacle wall to accommodate the necessary opening for receiving the plug key. Other keying arrangements utilize separate key structures that are added to the connector halves to effect the desired unique keying. An example of this keying approach is illustrated in U.S. Pat. No. 5,044,994 which discloses a small birth density connector wherein the plug has a key secured to an outside wall by a pair of flanges and the receptacle has a corresponding key secured to the inside surface of a wall so that when mated the two keys are mutually opposed. The receptacle and plug keys each have a groove and projection combination formed therein so that they mate. Such a structure requires that the connector be made wider to accommodate the keys than would otherwise be necessary. And, since all of the keys are on the same side of the connector, there is no provision for prevention of inadvertent mating of the contacts along the opposite edge of the connector. Such inadvertent mating can be harmful to the connector contacts as well as to the circuitry on the circuit board and to related equipment.

What is needed is a connector keying arrangement that effectively prevents inadvertent partial mating of the contacts of a plug with the contacts of a receptacle either along an edge of the connector or an end thereof. Additionally, the keying arrangement should not require that the connector be made larger to accommodate the keys or to require additional space on the circuit board.

SUMMARY OF THE INVENTION

An electrical connector is disclosed having a mating plug and receptacle. Each plug and receptacle includes a housing having electrical contacts therein wherein each contact of the plug mates with a corresponding contact of the receptacle. The connector includes a first keying arrangement for polarizing to assure proper orientation of the plug with the receptacle during mating thereof, and a second keying arrangement for inhibiting the mating except for mating a plug to a designated receptacle. The second keying arrangement includes a first opening in surface of a first side of the receptacle housing and a second opening in a surface of a second side thereof opposite said first side. A third opening is provided in a surface of a first side of the plug housing substantially opposed to the first opening when the plug and receptacle housings are in mated engagement. A fourth opening is provided in a surface of a second side of the plug housing and substantially opposed to the third opening when the plug and receptacle housings are in mated engagement. The connector includes a pair of first keys, wherein a first key is in each of either the first and second openings or the third and fourth openings, each first key having a projection at a preselected position thereon extending into the other of the openings. A pair of second keys are included in the other of the first and second openings and the third and fourth openings, each of which has a cavity for receiving a respective projection. Each projection and cavity are positioned in one of a plurality of discrete selectable positions, so that the plug and receptacle housings will mate only when both projections of the first keys are received by and extend into their respective cavities of the second keys.

DESCRIPTION OF THE PREFERRED EMBODIMENT

Figure 1:
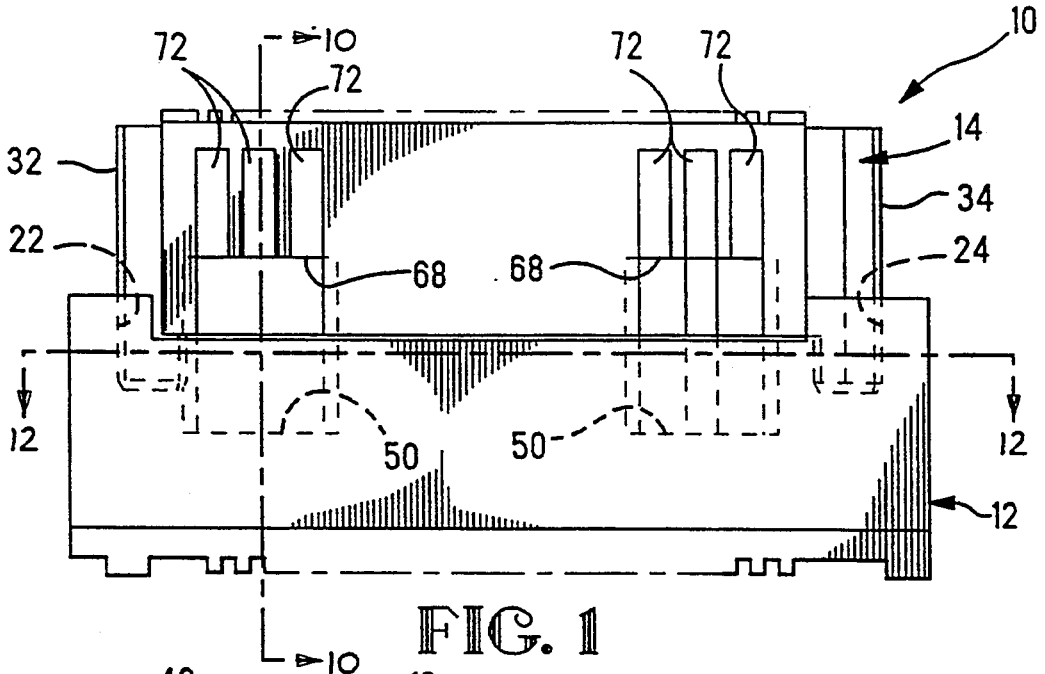
FIG. 1 is a front view of a mating connector assembly incorporating the teachings of the present invention and showing the plug partially engaging the receptacle.
Figure 2:
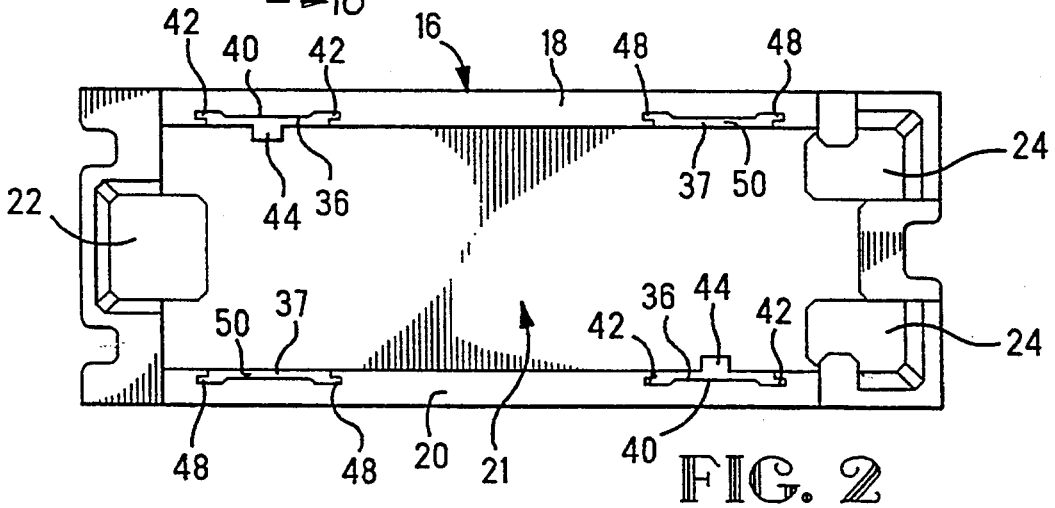
FIG. 2 is a top view of the receptacle shown in FIG. 1, showing its mating face.
Figure 3:
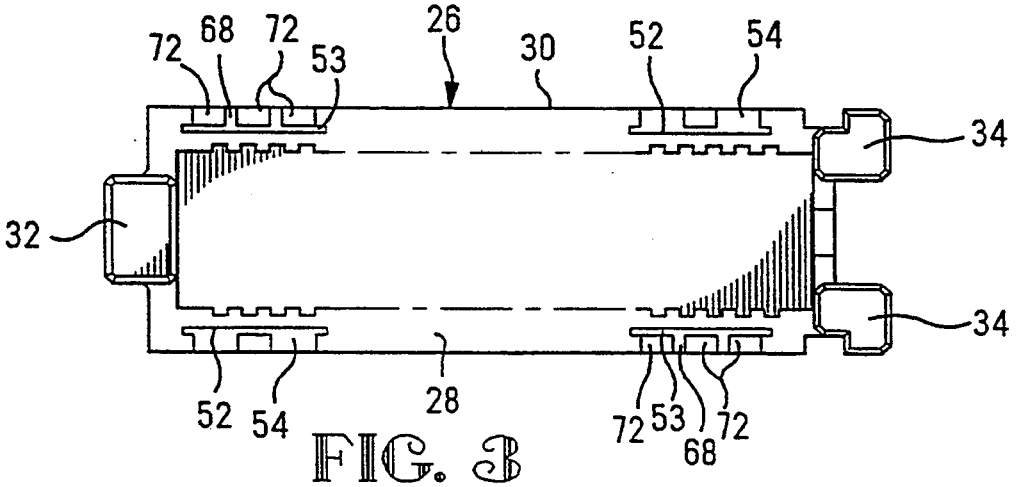
FIG. 3 is a bottom view of the plug shown in FIG. 1, showing its mating face.

There is shown in FIG. 1 an electrical connector 10 having a receptacle 12 and a mating plug 14 with their respective mating faces visible in FIGS. 2 and 3. The receptacle 12 includes an insulating housing 16, as best seen in FIG. 2, having opposite side walls 18 and 20 which form an interior cavity 21. Note that the contact cavities and other features of the interior of the receptacle housing are not shown. A rectangular opening 22 is formed in one end of the receptacle housing 16 and a pair of L-shaped openings 24 are formed in the other end. The plug 14 includes an insulating housing 26, as best seen in FIG. 3, having opposite side walls 28 and 30, which are spaced to closely fit within the interior cavity 21 of the receptacle housing 16 when the plug is mated with the receptacle. Note that the contact cavities and other interior features of the plug housing are not shown. When the plug and receptacle housings are mated the side wall 18 is adjacent the side wall 28 and the side wall 20 is adjacent the side wall 30. The plug housing 26, as shown in FIG. 3, includes a rectangular projection 32 at one end and a pair of L-shaped projections 34 at the other end that are sized to closely fit within the openings 22 and 24, respectively, when the plug is mated to the receptacle. These projections and openings are a polarizing keying system that assures proper orientation of the plug and receptacle during mating.

Figure 4:
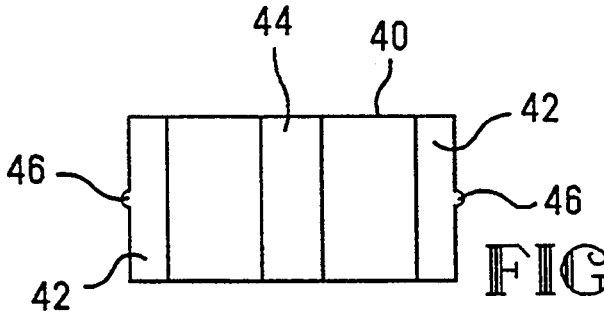
FIGS. 4 and 5 are side and top views of a receptacle key.
Figure 5:
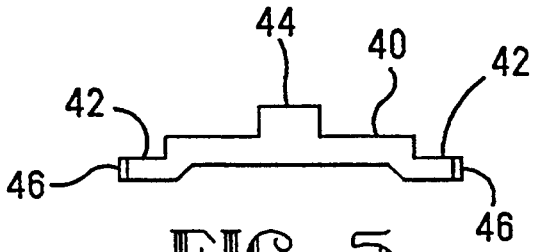
Figure 6:
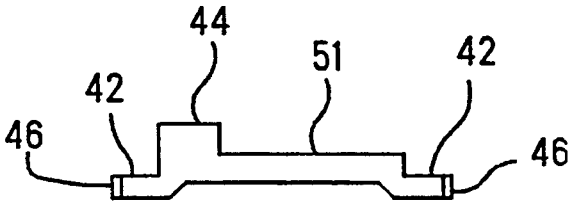
FIG. 6 is a top view of another receptacle key.

A second keying system will now be described that uniquely associates a plug housing to a designated receptacle housing so that the plug will only mate with its designated receptacle. The receptacle housing 16 includes four openings, an opening 36 and an opening 37 in each of the side walls 18 and 20 as shown in FIG. 2. The openings in each side wall are spaced apart so that they are adjacent the ends of the housing, and so that the openings in opposite side walls are opposite and in substantial mutual alignment. The openings 36 are diagonally opposite each other as are the openings 37, for a purpose that will become apparent. There is shown in FIGS. 4 and 5 a receptacle key 40 having a pair of side ears 42 and a central projection 44. The receptacle key 40 is dimensioned to fit snugly into either of the openings 36 and 37 in the receptacle housing 16. A pair of shallow projections 46 are formed on the side edges of the ears 42 to provide a slight interference when the key in inserted into the opening so that the key is held in place. The openings 36 and 37 are grooves formed in the interior surfaces of the side walls and include undercuts 48 that receive the ears 42 end hold the keys captive within the openings. Each of the openings 36 and 37 terminates in a shoulder 50 against which the key 40 is seated. The projection 44 of each key 40 extends well into the interior cavity 21 of the receptacle housing 16 for a purpose that will become apparent. A second receptacle key 51 is shown in FIG. 6 and is identical to the key 40 except that the projection 44 is shifted to the left.

Figure 7:
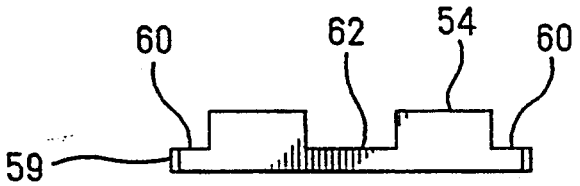
FIGS. 7, 8, and 9 are top views of various plug keys.
Figure 8:
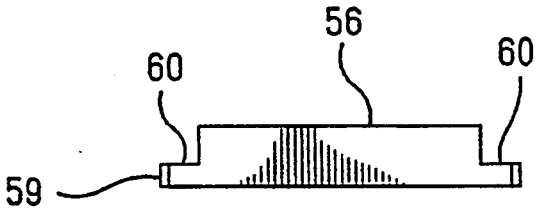
Figure 9:
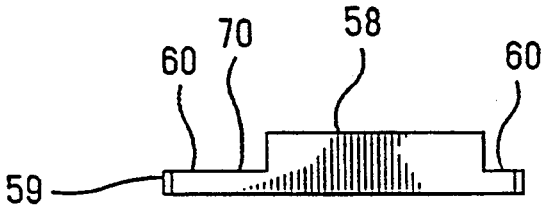

The plug housing 26 includes four openings, an opening 52 and an opening 53 in each of the side walls 28 and 30 as shown in FIG. 3. The openings 52 and 53 in each side wall are spaced apart so that they are adjacent the ends of the housing, and so that the openings in opposite side walls are opposite and in substantial mutual alignment with respective openings 36 and 37 when the plug housing 26 is mated with the receptacle housing 16. The openings 52 are diagonally opposite each other as are the openings 53. There are shown in FIGS. 7, 8, and 9 three plug keys 54, 56, and 58, respectively, each having a pair of side ears 60. The plug key 54 includes a groove 62 centrally disposed between the ears 60 and having a width and depth to receive therewithin the projection 44 of the receptacle key 40. The plug keys 54, 56, and 58 all fit snugly into their respective openings 52 and 53 in the plug housing 26 and include shallow projections 59 on the edges of the ears for providing an interference fit in a manner similar to the projection 46 of key 40. Each of the openings 52 and 53 terminates in a shoulder 68 against which its respective plug key is seated. The groove 62 of the key 54, as shown in FIG. 7, has shifted to the left in FIG. 9 so that it forms a rabbet 70 adjacent the left most ear 60 of the key 58. When the plug key 58 is in place within an opening 52 in the plug housing, the rabbet 70 forms a groove with the end of the opening 52 that is of the same width as that of the groove 62. Each of the openings 52 and 53 includes three extension grooves 72 that are in alignment with and correspond to the two possible positions of the grooves formed by the rabbet 70 and the central groove 62 when the plug keys 54 and 58 are in place. Note that the key 58 will fit into the opening 52 and 53 with its rabbet 70 facing in either direction so that a groove can be formed with either the right or left end of the opening.

The operation of the present invention will now be described with reference to FIGS. 2, 3, 10, 11, and 12. A pair of receptacle keys 40 are pressed into the two diagonally disposed openings 36 of the receptacle housing, as shown in FIG. 2. The other two openings 37 remain empty. Similarly, a pair of plug keys 54 are pressed into the diagonal openings 52 in the plug housing 26 so that when the plug is mated with the receptacle each plug key will be in opposing position with respect to a respective receptacle key 40. Each of the two remaining openings 53 receives a plugging key 56 having no groove to prevent mating with a receptacle having a key 40 corresponding to this position.

Figure 10:
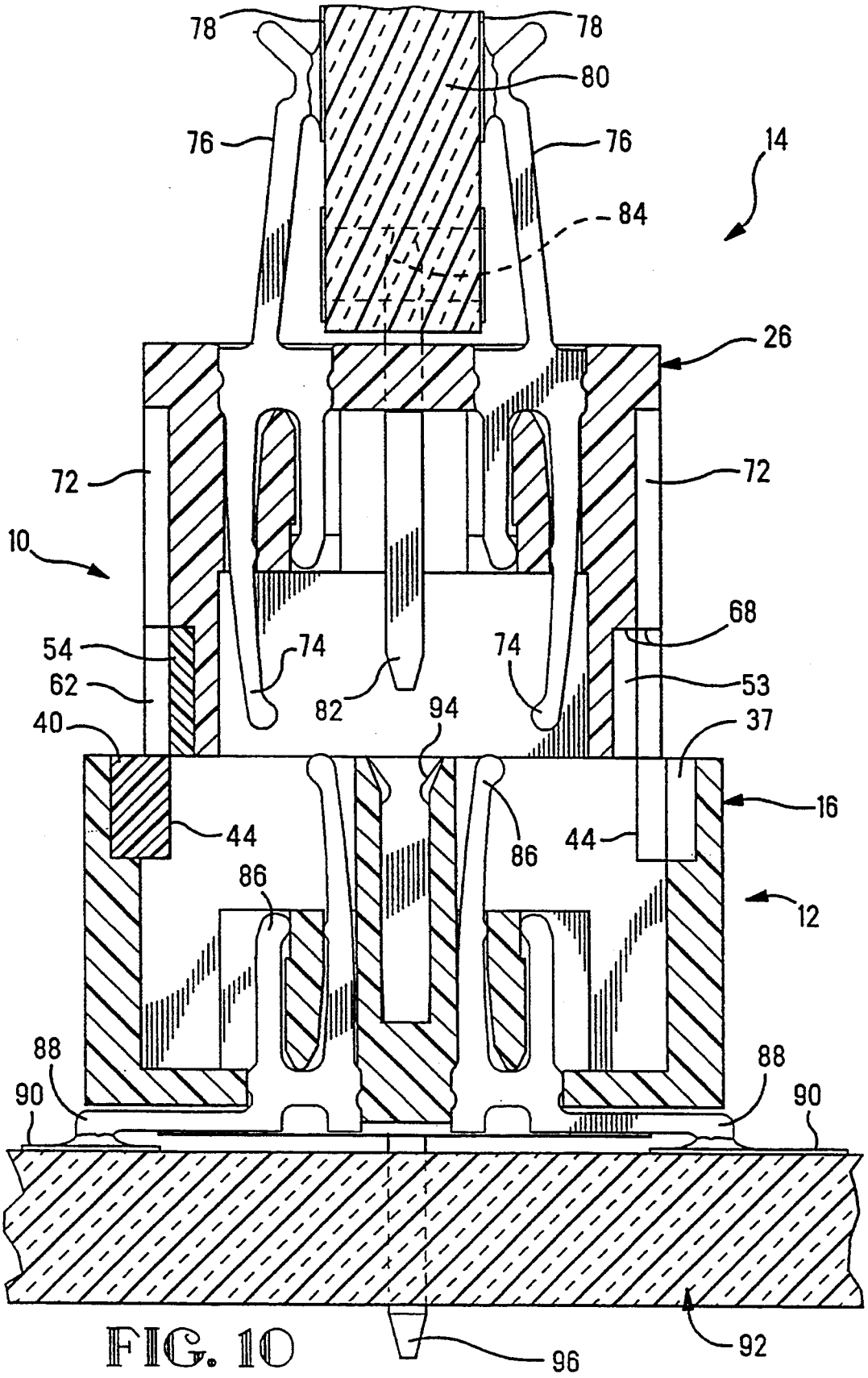
FIG. 10 is a cress-sectional view taken along the lines 10—10 of FIG. 1 showing the plug and receptacle prior to mating.

The receptacle 12 and plug 14 are shown in FIG. 10 in cross section, in vertically aligned position ready for mating. This is substantially the same position as shown in FIG. 1. The receptacle and plug, 12 and 14 respectively, are shown in FIG. 10 in a typical application where the plug includes a series of electrical contacts 74 disposed in cavities in the plug housing 26. The contacts 74 have solder tails 76 that are soldered to circuit pads 78 on the major surfaces of a circuit board 80. A series of ground contacts 82 have tails 84 that project into openings in the edge of the circuit board and are electrically connected to ground circuitry on the circuit board. Similarly, the receptacle 12 includes a series of contacts 86 having solder tails 88 that are soldered to pads 90 on another circuit board 92, and ground contacts 94 having tails 96 that extend into holes in the circuit board and engage ground circuitry on the circuit board 92. When the plug and receptacle are mated the contacts 74 mate with the contacts 86 and the ground contacts 82 mate with the ground contacts 94 in the usual manner.

Figure 11:
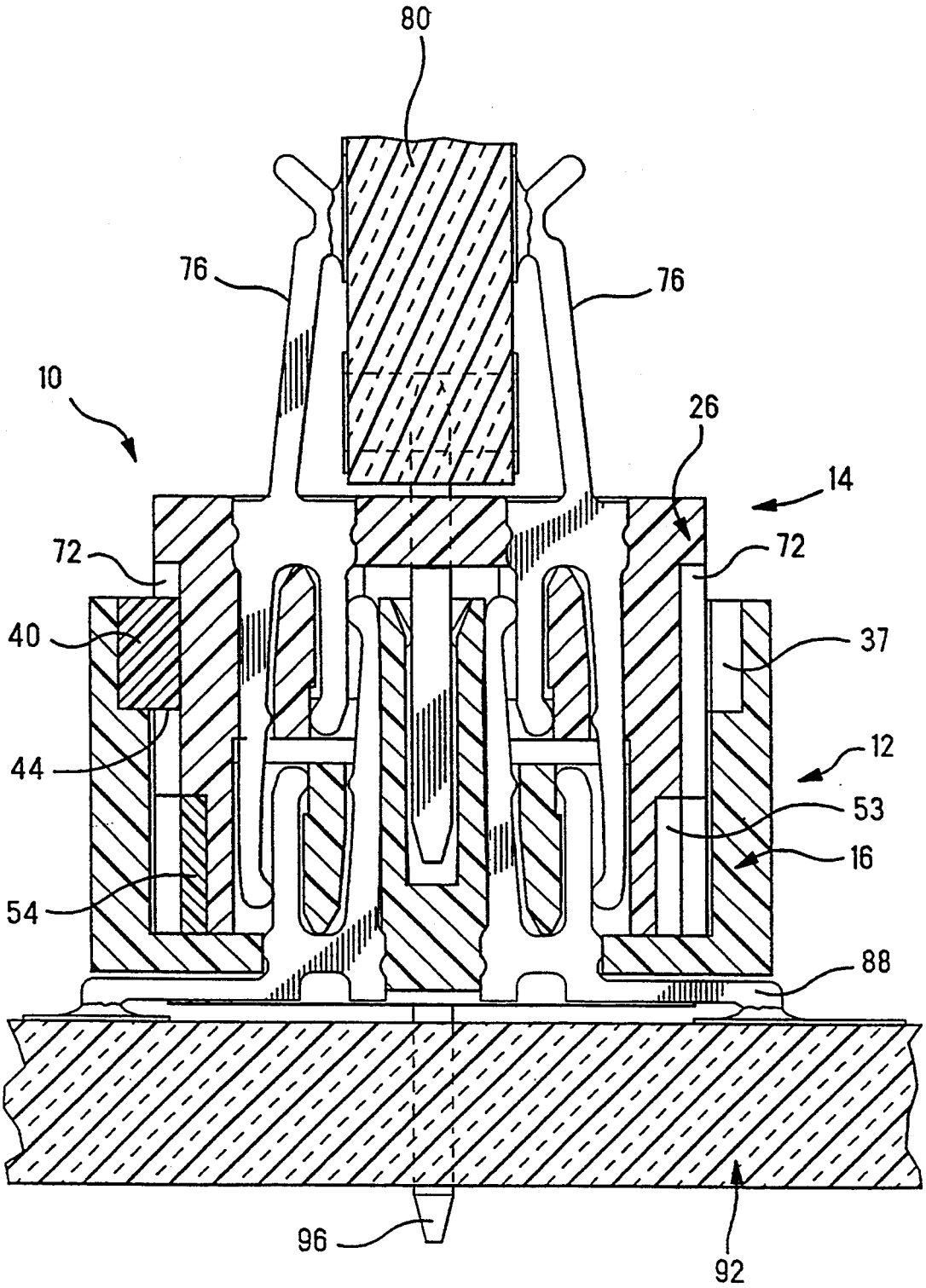
FIG. 11 is a view similar to that of FIG. 10 showing the plug fully mated with the receptacle.
Figure 12:
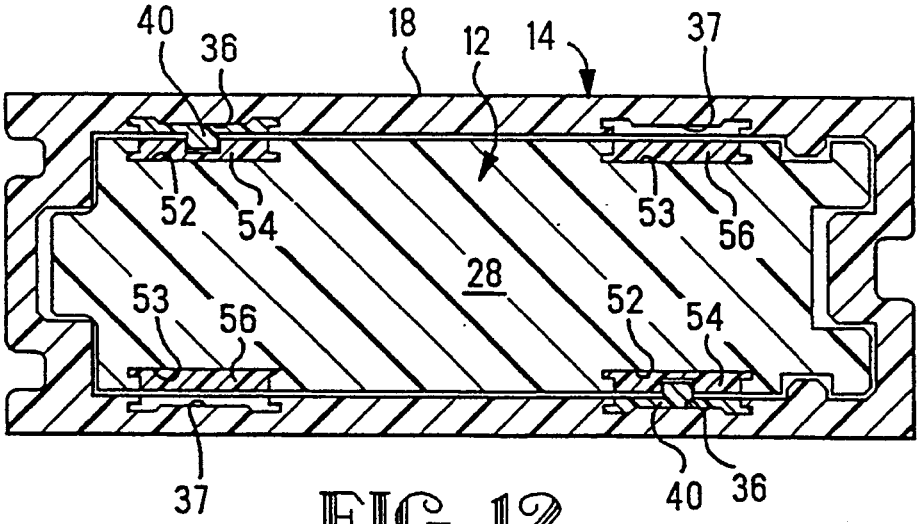
FIG. 12 is a cross-sectional view taken along the lines 12—12 of FIG. 1 but with the plug more fully mated with the receptacle.

As the plug 14 is brought into position with respect to the receptacle 12, as shown in FIG. 10, the projections 32 and 34 enter the rectangular and L-shaped openings 22 and 24 (as seen in FIG. 1), thereby assuring that the plug is properly oriented with respect to the receptacle. As insertion of the plug continues, the cavities 62 of the two plug keys 54 receive the projection 44 of each of the two diagonally disposed receptacle keys 40 thereby assuring that the plug and receptacle are a designated pair that are intended to be mated. Insertion of the plug 14 continues until it is fully seated in the receptacle 12, as shown in FIG. 11. (While a projection 44 is visible on the right side of connector 12 in FIG. 10, it is at the far end and does not enter opening 52 of connector 14 during mating; therefore opening 52 remains empty in FIG. 11 as projection 44 becomes hidden.) As is shown there, the plug keys 54 have completely passed their corresponding receptacle keys 40 so that the projections 44 of the receptacle keys are now within the extension grooves 72, which are intended to only provide clearance for the projections. FIG. 12 is a cross-sectional view showing the plug 14 and receptacle 12 partially mated to illustrate the relationship of the receptacle keys 40 with the plug keys 54 when they are in mutual engagement. As shown, the diagonally opposed openings 37 in the receptacle housing 18 are left empty, but their opposing openings 53 in the plug housing 28 contain the plugging keys 56. This prevents insertion of the plug into a receptacle having a key 40 or 51 in this position.

Figure 13:
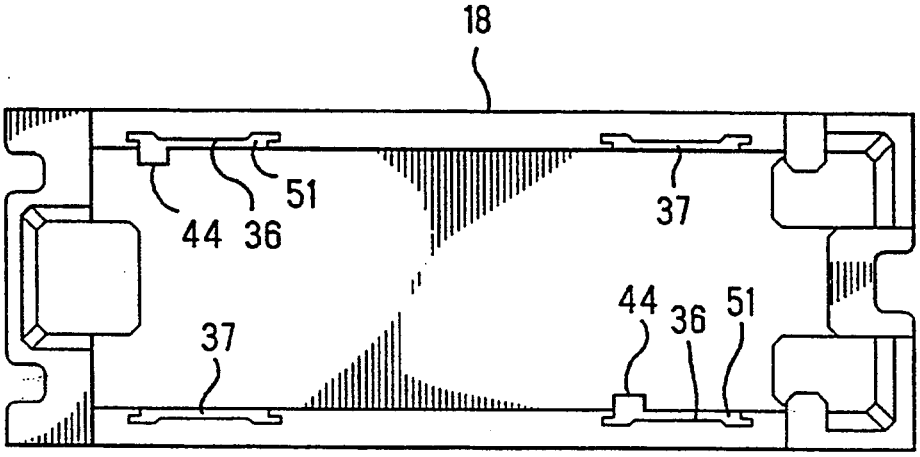
FIGS. 13 and 14 are views similar to those of FIGS. 2 and 3 showing different keying arrangement.
Figure 14:
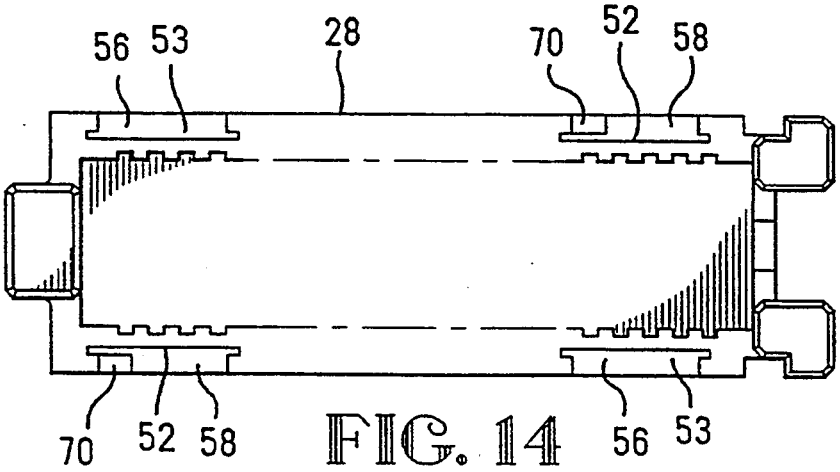
Figure 15:
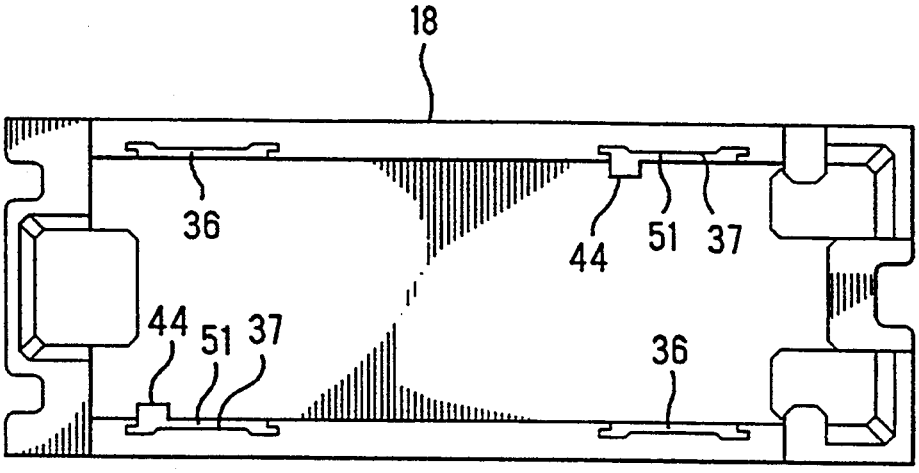
FIGS. 15 and 16 are views similar to those of FIGS. 13 and 14 showing the keys in alternate positions.
Figure 16:
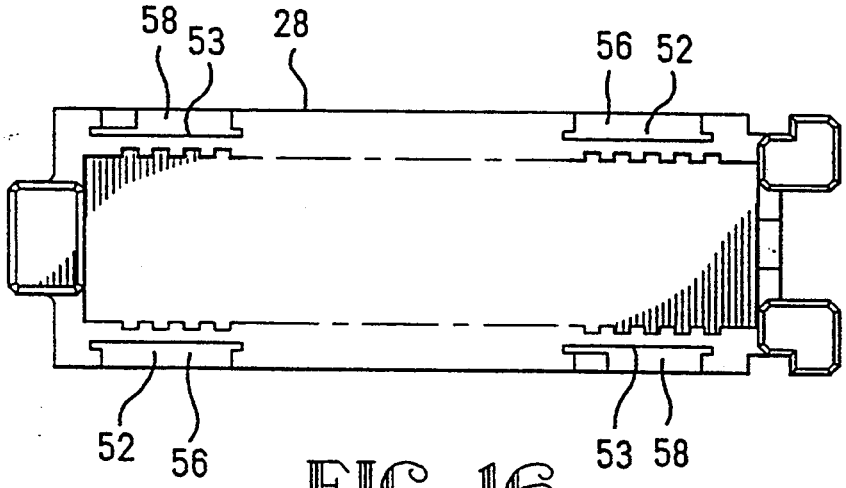

FIGS. 13 and 14 are similar to the views of FIGS. 2 and 3 but show the receptacle key 51 in the two diagonal openings 36 instead of the keys 40 and the plug keys 58 in the corresponding openings 52 instead of the keys 54, thereby providing a second unique keying arrangement. By turning the two receptacle keys 51 over 180 degrees and inserting them into the same openings 36 the projections 44 will be adjacent the opposite ends of the openings. Then, making the corresponding change with the plug keys 58 to shift the rabbets 70 to be opposed to the projections 44, a third unique keying arrangement, not shown, is provided. Three additional keying arrangements are obtainable by moving the receptacle keys from the diagonally opposed openings 36 to the openings 37 and moving the plug keys from the openings 52 to the diagonally opposed openings 53, as shown in FIGS. 15 and 16. There, the receptacle keys 51 are shown in the openings 37 of the receptacle housing 16 and the plug keys 58 are shown in the openings 53 of the plug housing 26, thereby providing a fourth unique keying arrangement. By turning the keys 51 and 58 over 180 degrees in their respective openings 37 and 53, in the manner described above, a fifth unique keying arrangement is provided. And finally, by replacing the keys 51 and 58 with the keys 40 and 54 in their respective openings 37 and 53, a sixth unique keying arrangement is provided.

As will be appreciated by those skilled in the art, a plug set up with one of these keying arrangements will not mate with a receptacle set up with another of these keying arrangements. In such a case the projections 32 and 34 of the plug would begin to enter the openings 22 and 24 of the receptacle to assure proper polarizing, but the projection 44 of the two receptacle keys would engage the surfaces of the opposing plug keys and prevent further insertion of the plug into the receptacle. Under these conditions the maximum insertion that would be obtainable is that shown in FIG. 10. Note that the contacts of the plug are spaced well away from the contacts of the receptacle so that there is no possibility of inadvertent interconnection of the contacts. Such inadvertent interconnection is prevented even in the case where an attempt is made to force one end of the plug into an end of the receptacle, since there is a key 40 at both ends of the receptacle, penetration is avoided. Further, because the keys 40 are on diagonally opposite sides, it is not possible to force only one side of the plug into the receptacle sufficiently far to cause the inadvertent interconnection. While, in the present example, only six unique keying arrangements are shown, it is possible, where space permits, to lengthen the keys and their openings to provide additional keying arrangements by providing additional positions for the projection 44 and the corresponding grooves 62,70. Additionally, the projection 44 and groove 62 may be made narrower to accommodate more positions. However, in the present example, the very small size of the parts tends to limit efforts to expand the number of combinations. For example, the wall thickness of the receptacle housing is only about 0.030 inch. After forming the opening 36 in the wall there is only about 0.010 inch of material left. The situation for the plug housing is even more desperate since the wall thickness is only about 0.026 inch resulting in only about 0.008 inch of material being left after the opening 52 is formed. These connectors have 104 double contacts per inch of connector housing. Such dimensions are becoming more typical in the industry making it very difficult to provide effective keying arrangements that are reasonably economical to manufacture.

An important advantage of the present invention is that a unique keying arrangement is provided that effectively prevents even partial mating of the ends of a plug to the wrong receptacle in very small but high density connectors where space is critically limited. Additionally, the keys can be changed in the field to accommodate changing requirements. The present keys are disposed within openings formed in the existing walls of the plug and receptacle housings so that additional space is not needed for the keys nor is the connector made larger in any way. This helps to conserve circuit board space in an industry where circuit board space is at a premium. Since the openings for the keys do not extend through the walls, the strength of the housing is not compromised.

I claim:

1. In an electrical connector having a mating plug and receptacle, each plug and receptacle including a housing having electrical contacts therein, wherein each contact of said plug mates with a corresponding contact of said receptacle, and a first keying arrangement for polarizing to assure proper orientation of said plug with said receptacle during mating thereof, a second keying arrangement for inhibiting said mating except for mating a plug to a designated receptacle, comprising:

(a) a first opening in a surface of a first side of said receptacle housing;

(b) a second opening in a surface of a second side of said receptacle housing opposite said first side;

(c) a third opening in a surface of a first side of said plug housing substantially opposed to said first opening when said plug and receptacle housings are in mated engagement;

(d) a fourth opening in a surface of a second side of said plug housing substantially opposed to said third opening when said plug and receptacle housings are in mated engagement;

(e) a pair of first keys, a first key removably insertable into either each of said first and second openings of said receptacle housing or each of said third and fourth openings of said plug housing, each said first key having a projection at a preselected position thereon extending from one of said plug and receptacle housings into the opposed openings of the other of said plug and receptacle housings;

(f) a pair of second keys, a second key removably insertable into the other of said first and second openings of said receptacle housing or said third and fourth openings of said plug housing, each of which has a cavity for receiving a respective said projection, wherein each said projection and each said cavity are positioned in one of a plurality of discrete selectable positions by reason of a plurality of openings and a plurality of positions along said keys, and wherein said plug and receptacle housings will mate only when both said projections of said first keys are received by and extend into their respective cavities of said second keys.

2. The electrical connector according to claim 1 wherein said first and second openings are diagonally opposite each other.

3. The electrical connector according to claim 2 wherein said first keys are in said first and second openings and said second keys are in said third and fourth opening.

4. The electrical connector according to claim 3 wherein said receptacle housing has side walls that substantially surround and form an interior cavity and said plug has a portion having side walls wherein said portion is received within said cavity so that each said side wall of said receptacle is adjacent a respective one of said side walls of said plug portion, and wherein said first, second, third, and fourth openings are arranged in said side walls so that said first and second keys are within their respective openings and substantially flush with said surfaces of the respective said walls of said housing, except that said projections of said first keys extend beyond their respective said walls.

5. The electrical connector according to claim 4 wherein each said key is removably slidable into its respective opening.

6. The electrical connector according to claim 5 wherein each of said first, second, third, and fourth openings is a groove formed in and parallel with the surface of a respective said side wall but not extending through said side wall, each said groove having an undercut for holding its respective key captive therein.

7. The electrical connector according to claim 6 wherein each said first and second key includes an ear that is received in said undercut, said ear having a shallow projection that interferingly engages a wall of said undercut for holding said key within its respective groove.

8. The electrical connector according to claim 2 including:

a fifth opening in a surface of said first side of said receptacle housing opposite said second opening;

(b) a sixth opening in a surface of said second side of said receptacle housing opposite said first opening;

(c) a seventh opening in a surface of said first side of said plug housing substantially opposed to said fifth opening when said plug and receptacle housings are in mated engagement;

(d) an eighth opening in a surface of said second side of said plug housing substantially opposed to said sixth opening when said plug and receptacle housings are in mated engagement;

wherein said first keys are arranged to be in either said first and second openings or said fifth and sixth openings of said receptacle housing and said second keys are arranged to be in either said third and fourth openings or said seventh and eighth openings of said plug housing.

9. The electrical connector according to claim 8 wherein said receptacle housing has side walls that substantially surround and form an interior cavity and said plug has a portion having side walls wherein said portion is received within said cavity so that each of said side walls of said receptacle is adjacent a respective one of said side walls of said plug portion, and wherein said openings are arranged in said side walls so that said first and second keys are within their respective openings and substantially flush with said surfaces of the respective said walls of said housing, except that said projections of said first keys extend beyond their respective said walls.

10. The electrical connector according to claim 9 wherein each said key is removably slidable into its respective opening.

11. The electrical connector according to claim 10 wherein each of said openings is a groove formed in and parallel with the surface of a said side wall but not extending through said side wall, each said groove having an undercut for holding its respective key captive therein.

12. The electrical connector according to claim 11 wherein each said first and second key includes an ear that is received in said undercut, said ear having a shallow projection that interferingly engages a wall of said undercut for holding said key within its respective groove.

* * * * *